US011384671B2

(12) United States Patent
Kurpejovic

(10) Patent No.: US 11,384,671 B2
(45) Date of Patent: Jul. 12, 2022

(54) GAS/GAS MIXER FOR INTRODUCING GAS INTO THE EXHAUST GAS STREAM OF AN INTERNAL COMBUSTION ENGINE

(71) Applicant: Eberspächer Exhaust Technology GmbH, Neunkirchen (DE)

(72) Inventor: Enver Kurpejovic, Kirchheim (DE)

(73) Assignee: PUREM GMBH, Neunkirchen (DE)

( * ) Notice: Subject to any disclaimer, the term of this patent is extended or adjusted under 35 U.S.C. 154(b) by 0 days.

(21) Appl. No.: 17/152,203

(22) Filed: Jan. 19, 2021

(65) Prior Publication Data

US 2021/0222605 A1 Jul. 22, 2021

(30) Foreign Application Priority Data

Jan. 20, 2020 (DE) ..... 10 2020 101 134.2

(51) Int. Cl.
*F01N 3/20* (2006.01)
*F01N 3/28* (2006.01)
*F01N 3/30* (2006.01)

(52) U.S. Cl.
CPC ..... *F01N 3/2892* (2013.01); *F01N 3/206* (2013.01); *F01N 3/30* (2013.01); *F01N 2240/20* (2013.01); *F01N 2610/1453* (2013.01)

(58) Field of Classification Search
CPC ..... F01N 3/206; F01N 3/2892; F01N 3/30; F01N 2240/20; F01N 2610/1453; B01F 3/026; B01F 5/0688
USPC ..... 60/317, 324
See application file for complete search history.

(56) References Cited

U.S. PATENT DOCUMENTS

| | | | | |
|---|---|---|---|---|
| 9,810,123 | B2 * | 11/2017 | Kauderer | F01N 13/0097 |
| 2015/0110681 | A1 * | 4/2015 | Ferront | F01N 3/2892 422/168 |
| 2016/0361694 | A1 * | 12/2016 | Brandl | B01F 5/0473 |
| 2017/0136410 | A1 | 5/2017 | Zhang | |
| 2017/0260888 | A1 * | 9/2017 | Solipuram | B01F 5/0688 |

FOREIGN PATENT DOCUMENTS

| | | | |
|---|---|---|---|
| CN | 107869376 | A | 4/2018 |
| DE | 102013215632 | A1 | 2/2014 |
| DE | 102013221428 | A1 | 4/2015 |
| DE | 102016121870 | A1 | 5/2017 |
| DE | 102016119306 | A1 | 4/2018 |
| DE | 102018108592 | A1 | 10/2019 |

* cited by examiner

*Primary Examiner* — Audrey B. Walter
(74) *Attorney, Agent, or Firm* — McGlew and Tuttle, P.C.

(57) ABSTRACT

A gas/gas mixer for introducing gas into an exhaust gas stream of an internal combustion engine. The gas/gas mixer includes an exhaust gas flow duct (18) in an exhaust gas carrying element (14), through which exhaust gas (A) can flow. A mixer body (20) is arranged in the exhaust gas carrying element (14) with a plurality of exhaust gas flow openings (44), through which exhaust gas (A) flowing in the exhaust gas flow duct (18) can flow. A gas feed volume (38), through which gas (G) to be introduced into the exhaust gas stream (A) can flow, is formed in the mixer body (20). The gas feed volume (38) is open towards the exhaust gas flow duct (18) via a plurality of gas release openings (56).

16 Claims, 2 Drawing Sheets

GAS/GAS MIXER FOR INTRODUCING GAS INTO THE EXHAUST GAS STREAM OF AN INTERNAL COMBUSTION ENGINE

CROSS REFERENCE TO RELATED APPLICATIONS

This application claims the benefit of priority under 35 U.S.C. § 119 of German Application 10 2020 101 134.2, filed Jan. 20, 2020, the entire contents of which are incorporated herein by reference.

TECHNICAL FIELD

The present invention pertains to a gas/gas mixer, with which gas can be introduced into the exhaust gas stream of an internal combustion engine.

TECHNICAL BACKGROUND

A gas/gas mixer in which a mixer body with a drop-like cross section protrudes into an exhaust gas flow duct formed in a tubular exhaust gas carrying element is known from DE 10 2018 108 592 A1. Exhaust gas flowing in the exhaust gas flow duct can flow around the mixer body in the manner of a support surface, and the mixer body has a plurality of gas release openings, via which a gas feed volume of gas flowing in the interior of the mixer body is released into the exhaust gas stream that is flowing around the mixer body.

SUMMARY

An object of the present invention is to provide a gas/gas mixer for introducing gas into the exhaust gas stream of an internal combustion engine, with which an improved mixing of exhaust gas with a gas to be introduced into the exhaust gas stream can be achieved.

This object is accomplished according to the present invention by a gas/gas mixer for introducing gas, especially air or burner exhaust gas, into the exhaust gas stream of an internal combustion engine, comprising an exhaust gas flow duct in an exhaust gas carrying element, through which exhaust gas can flow, a mixer body arranged in the exhaust gas carrying element with a plurality of exhaust gas flow openings, through which exhaust gas flowing in the exhaust gas flow duct can flow, wherein a gas feed volume, through which gas to be introduced into the exhaust gas stream can flow, is formed in the mixer body, and wherein the gas feed volume is open towards the exhaust gas flow duct via a plurality of gas release openings.

In the configuration according to the present invention, the gas/gas mixer has not only gas release openings, through which the exhaust gas to be introduced into the exhaust gas stream is released, but also has exhaust gas flow openings, through which the exhaust gas or at least a substantial part thereof flowing in the exhaust gas flow duct flows. As a result, when the exhaust gas flows through the exhaust gas flow openings on the downstream side of the mixer body, a swirling is generated, which brings about an efficient mixing of the gas that is released from the gas release openings of the mixer body and carried along by the exhaust gas stream.

For a configuration which can be embodied in a simple manner and which brings about an efficient flow of exhaust gas through the mixer body, it is proposed that the mixer body have a plate-shaped configuration and be arranged in the exhaust gas carrying element obliquely to an exhaust gas main flow direction of the exhaust gas flowing through the exhaust gas flow duct.

The gas feed volume can be provided in the mixer body, for example, by the mixer body comprising a first mixer body part that is arranged oriented in the upstream direction in the exhaust gas carrying element and a second mixer body part that is arranged in the downstream direction in the exhaust gas carrying element, wherein the gas feed volume is formed essentially between the first mixer body part and the second mixer body part.

In this connection, to obtain the plate-shaped configuration of the mixer body, the first mixer body part may have an essentially plate-shaped configuration and the second mixer body part may have an essentially plate-shaped configuration.

It should be pointed out in this connection that a structure of the mixer body and of the mixer body parts, in which these mixer body or mixer body parts have a markedly smaller thickness than their extension obliquely to the thickness direction, is addressed with the term "plate-shaped" in the sense of the present invention.

For fixing the mixer body to the exhaust gas carrying element. which fixing can be embodied in a simple manner, it is proposed that a fastening area fixed to the exhaust gas carrying element be provided at one of the mixer body parts, preferably at the second mixer body part, and that a second fastening area fixed to the one mixer body part be provided at the other mixer body part, preferably at the first mixer body part.

In this case, for example, the first fastening area may comprise a preferably essentially cylindrical fastening edge that is fixed to an inner circumferential surface of the exhaust gas carrying element in an outer circumferential area of the one mixer body part, or/and that the second fastening area may comprise a preferably essentially cylindrical fastening edge, which is fixed to the one mixer body part, in an outer circumferential area of the other mixer body part.

A plurality of flow-through holes may be provided for providing the exhaust gas flow openings in the second mixer body part, and a preferably tubular or funnel-shaped flow-through bulge, which extends to the second mixer body part, carries exhaust gas in the direction of the associated flow-through hole and provides a flow duct of the first mixer body part, may then be provided in the first mixer body part in association with each flow-through hole of the second mixer body part.

An efficient mixing of exhaust gas and gas to be introduced into same can be further supported by in at least one, preferably in each exhaust gas flow opening, a gas release opening being formed between a flow-through hole edge area of the second mixer body part, which flow-through hole edge area encloses the flow-through hole in the second mixer body part, and the flow-through bulge of the first mixer body part. The gas release openings have thus a ring-like structure and bypass, with this ring-like structure, each an area, in which exhaust gas flowing through a respective exhaust gas flow opening is carried.

As an alternative or in addition, at least one gas release opening may be provided in the second mixer body part between the flow-through holes provided in the second mixer body part. Further, at least one gas release opening may be provided in the first mixer body part, preferably in the area of at least one flow-through bulge.

Here, for a defined introduction of the gas into the exhaust gas stream between the exhaust gas flow openings, in at least one, preferably in each exhaust gas flow opening, the flow-through bulge may be in contact with a flow-through hole edge area of the second mixer body part, which flow-through hole edge area encloses the flow-through hole in the second mixer body part, preferably such that the gas feed volume is essentially closed against the discharge of gas in the area of this exhaust gas flow opening.

For a thermally stable configuration that can be embodied in a simple and cost-effective manner, it is proposed that the first mixer body part be a shaped sheet metal part, or/and that the second mixer body part be a shaped sheet metal part.

For feeding the gas to be introduced into the exhaust gas stream, at an outer circumferential area of the mixer body, a gas feed duct, which is passed through a wall of the exhaust gas carrying element, may be open towards the gas feed volume.

Efficient mixing of gas and exhaust gas can be further guaranteed by the mixer body being arranged in the exhaust gas carrying element such that exhaust gas essentially only flows through the exhaust gas flow openings in the exhaust gas flow duct in the area of the mixer body. It is thus guaranteed that the entire exhaust gas flowing in the exhaust gas flow duct flows through the exhaust gas flow openings provided in the mixer body and is thus sent into an area, in which the gas to be introduced into the exhaust gas is discharged from the mixer body.

The present invention further pertains to an exhaust system for an internal combustion engine of a vehicle, comprising a gas/gas mixer having the configuration according to the present invention.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
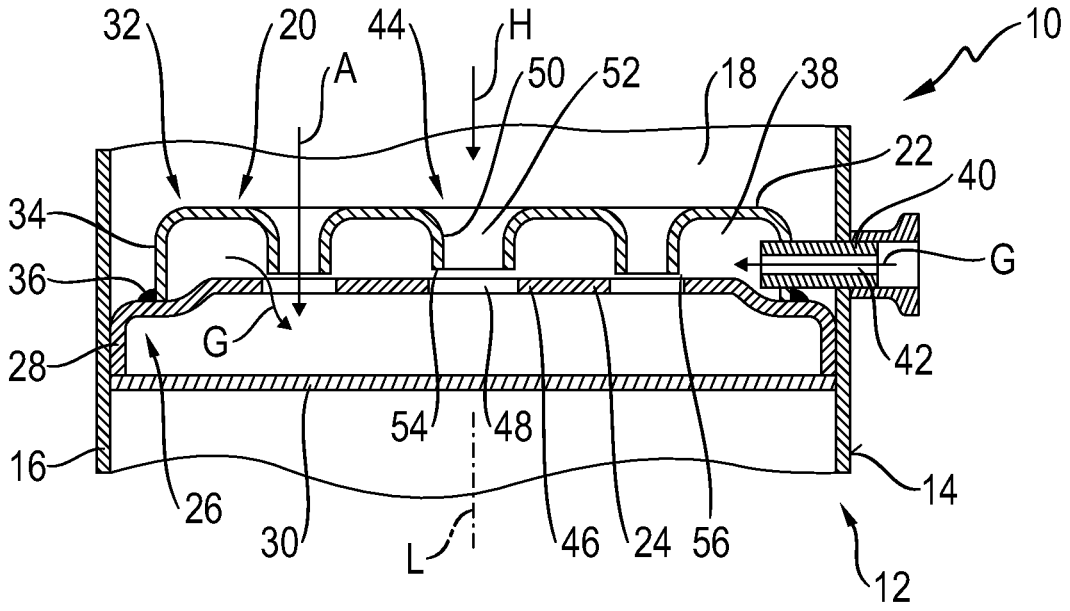
FIG. 1 is a partial longitudinal sectional view of a gas/gas mixer in an exhaust system of an internal combustion engine.

Referring to the drawings, FIG. 1 shows a gas/gas mixer 12 arranged in an exhaust system 10 of an internal combustion engine. The gas/gas mixer 12 comprises a tubular, for example, essentially cylindrical exhaust gas carrying element 14, which encloses an exhaust gas flow duct 18 with a tubular wall 16. In the exhaust gas flow duct 18, exhaust gas A flows essentially in an exhaust gas main flow direction H along the exhaust gas carrying element 14. It should be pointed out that flow directions deviating from the exhaust gas main flow direction H may be present locally. In principle, the exhaust gas main flow direction H may essentially also correspond to the longitudinal extension direction or to a longitudinal central axis L of the tubular exhaust gas carrying element 14.

The gas/gas mixer 12 comprises a mixer body 20 in the exhaust gas carrying element 14. The mixer body 20 has, in principle, a plate-shaped configuration, which means that its extension, for example, obliquely to the exhaust gas main flow direction H or to the longitudinal central axis L is markedly greater than its extension in the exhaust gas main flow direction H. The mixer body 20 is arranged in the exhaust gas carrying element 14 or in the exhaust gas flow duct 18 essentially obliquely to or at right angles to the exhaust gas main flow direction H, which means that the mixer body 20 with its direction of thickness or thickness extension is oriented essentially in the exhaust gas main flow direction H or in the direction of the longitudinal central axis L.

The mixer body 20 comprises two mixer body parts 22, 24. The first mixer body part 22 is arranged, in principle, in the exhaust gas flow duct 18 such that it is oriented in the upstream direction, so that the exhaust gas A flowing towards the mixer body 20 in the exhaust gas main flow direction H at first impinges on the first mixer body part 22. The second mixer body part 24 is oriented in the downstream direction in the exhaust gas flow duct 18 and is thus positioned essentially on the downstream side of the first mixer body part 22. The two mixer body parts 22, 24 also have a plate-shaped configuration and are provided, for example, as shaped sheet metal parts.

The second mixer body part 24 is adapted in its outer circumferential contour to the inner circumferential contour of the wall 16 of the tubular exhaust gas carrying element 14. If the exhaust gas carrying element 14 has, for example, a circular inner circumferential contour in the area, in which the mixer body 20 is positioned, then the outer circumferential contour of the second mixer body part is advantageously likewise circular.

For fixing to the wall 16 of the exhaust gas carrying element 14, the second mixer body part 24 has in an outer circumferential area 26 of same a fastening edge 28, which is bent in the exhaust gas main flow direction H and preferably extends completely circularly in the circumferential direction. In an end area, the fastening edge 28 is fixed by welding 30 to the inner surface of the wall 16 of the exhaust gas carrying element 14, so that when the fastening edge 28 is configured as extending completely circularly in the circumferential direction, the passage of exhaust gas between the wall 16 of the exhaust gas carrying element 14 and the second mixer body part 24 is not possible.

It should be pointed out that, in principle, the fastening edge 28 could also be configured with a plurality of fastening edge straps, which are deflected in the exhaust gas main flow direction H and provided at spaced locations to one another and fixed, for example, each by welding to the exhaust gas carrying element 14.

The first mixer body part 22 is fixed on the side of the plate-shaped second mixer body part 24, which side is oriented in the upstream direction. The first mixer body part 22 has an outer circumferential contour, which corresponds approximately to the outer circumferential contour of the second mixer body part 24 or to the inner circumferential contour of the exhaust gas carrying element, but has smaller dimensions than the second mixer body part 24. The first mixer body part 22 has, in its outer circumferential area 32, a fastening edge 34 that is deflected in the exhaust gas main flow direction H and preferably extends completely circularly in the circumferential direction. This fastening edge is fixed by welding 36 to the side of the second mixer body part 24, which side is oriented in the upstream direction.

It should be pointed out that the two mixer body parts 22, 24 could also be configured such that the first mixer body part 22 has somewhat larger dimensions than the second mixer body part 24 and has a fastening edge 34 extending to a greater extent in the exhaust gas main flow direction H. This fastening edge may then extend around the fastening edge 28 of the second mixer body part 24 on its outer side, so that the second mixer body part 24 can be inserted into the first mixer body part 22. The fastening edge 34 of the first mixer body part 22 is fixed by welding to the wall 16 of the exhaust gas carrying element 14, and the fastening edge 28 of the second mixer body part 24 is fixed by welding to the fastening edge 34 of the first mixer body part 22 or/and to the wall 16 of the exhaust gas carrying element 14. For example, the dimensions of the two fastening edge areas 34, 28 may be such that they end approximately in the same area in the exhaust gas main flow direction H and are connected by joint welding to the wall 16 of the exhaust gas carrying element 14.

A gas feed volume 38 is formed between the two mixer body parts 22, 24. In a circumferential area a gas feed line 40 is passed through the wall 16 of the exhaust gas carrying element 14 and through the fastening edge 34 of the first mixer body part 22 and is thus connected, for example, to each by welding permanently and in a gastight manner (gastight). A gas feed duct 42, which opens into the gas feed volume 38 and through which gas G to be introduced into the exhaust gas A is sent into the gas feed volume 38, is provided in the exhaust gas feed line 40.

The mixer body 20 has a plurality of exhaust gas flow openings 44, through which the exhaust gas A flowing in the exhaust gas main flow direction H towards the mixer body 20 or towards the first mixer body part 22 can flow through the mixer body 20. To provide the exhaust gas flow openings 44, which can be arranged distributed, for example, in a regular pattern, the second mixer body part 24 has a plurality of flow-through holes 48 surrounded by a flow-through hole edge area 46. For example, the flow-through holes 48 may have a circular contour.

A flow-through bulge 50 is provided at the first mixer body part 22 in association with each flow-through hole 48 in the second mixer body part 24. This flow-through bulge 50 may be provided, for example, as a flanged hole and with its tubular or funnel-shaped structure provides a flow duct 52 for the exhaust gas A. Because of the constriction of the flow cross section occurring in the area of the exhaust gas flow openings 44, the exhaust gas A flowing through the exhaust gas flow openings 44 is accelerated during the passage through the exhaust gas flow openings 44, so that the flow velocity increases.

The first mixer body part 22 is dimensioned or shaped in the area of its flow-through bulges 50 such that a ring-like intermediate space, which provides a gas release opening 56, is formed in each case between the downstream end areas 54 of the flow-through bulges 50 and the corresponding flow-through hole edge areas 46. The gas G introduced into the gas feed volume 38 is discharged from the gas feed volume 38 via these gas release openings 56 having a ring-like configuration and thus reaches the stream of the exhaust gas A flowing through the flow-through bulges 50 or in the flow ducts 52. Because of the fact that the exhaust gas A is accelerated in the area of the exhaust gas flow openings 44 and a swirling is generated during the passage through the flow-through holes 48 or downstream thereof, the gas G introduced into the exhaust gas stream in these areas is efficiently mixed with the exhaust gas A. Since the flow-through bulges 50 are dimensioned or coordinated with the flow-through holes 48 such that these flow-through bulges have a smaller dimension especially in the area of their downstream edges 54 than the flow-through holes 48, it is guaranteed that the exhaust gas A flowing through the flow ducts 52 is sent through the flow-through holes 48 such that no exhaust gas A can reach the gas feed volume 38 via the gas release openings 56, even if, as shown in FIG. 1, the flow-through bulges 50 end in the exhaust gas main flow direction H in front of the second mixer body part 24 and thus already in front of the flow-through holes 48. Rather, because of the comparatively high flow velocity of the exhaust gas A in the area of the flow ducts 52, a suction pump effect is generated, which suctions the gas G present in the exhaust gas feed volume 38 independently of a possibly present gas overpressure into the stream of the exhaust gas flowing through the flow ducts 52.

Figure 2:
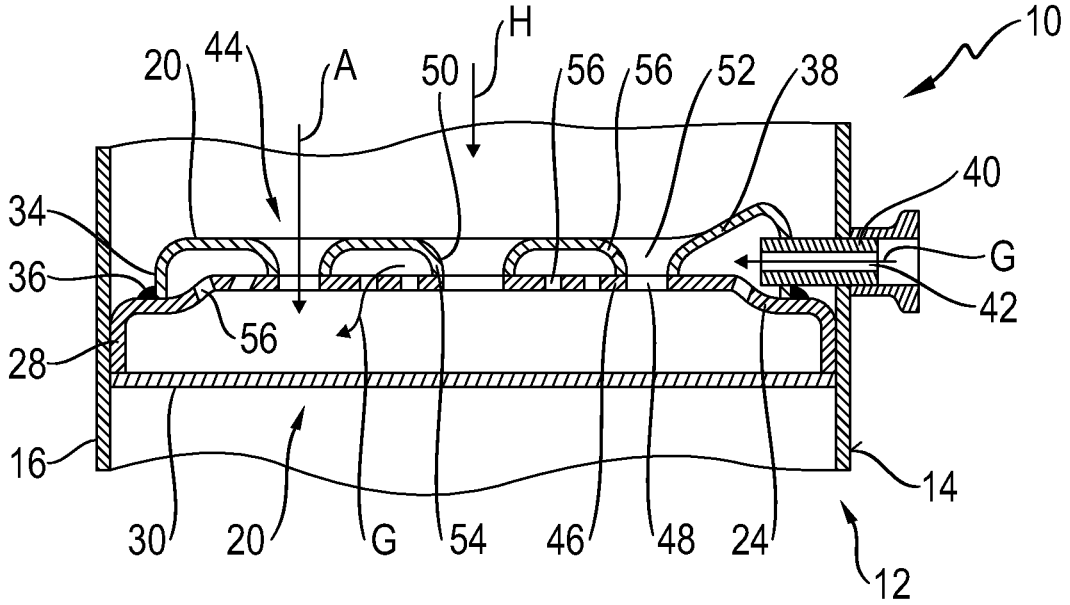
FIG. 2 is a view corresponding to FIG. 1 of an alternative type of configuration of the gas/gas mixer.

FIG. 2 shows a modified type of embodiment of the exhaust gas mixer 12. In regard to the basic configuration of the mixer body 20 with its two mixer body parts 22, 24, the configuration in this case corresponds to the configuration described above. In this embodiment, the two mixer body parts 22, 24 also have a plate-shaped configuration, for example, as shaped sheet metal parts. The second mixer body part 24 is with its fastening edge 28 fixed by welding 30 to the wall 16 of the exhaust gas carrying element 14, and the first mixer body part 22 is fixed with its fastening edge 34 by welding 36 to the second mixer body part 24, so that the gas feed volume 38 is formed between the two mixer body parts 22, 24.

In the embodiment shown in FIG. 2, the flow-through bulges 50 are shaped or coordinated with the flow-through holes 48 associated with each of these bulges 50 such that the downstream end areas 54 of the flow-through bulges 50 are in contact with the flow-through hole edge areas 46 of each of the associated flow-through holes 48. Thus, essentially no intermediate space is formed in the area, in which the flow-through bulges 50 adjoin the associated flow-through hole edge areas 46, so that a discharge of gas G from the gas feed volume 38 directly in the area of the exhaust gas flow openings 44 is essentially not intended. For example, the flow-through bulges 50 with their downstream end areas 54 can be pressed against the associated flow-through edge areas 46 when the first mixer body part 22 is connected to the second mixer body part 24, so that an essentially gastight closing forms. Gas leaks in these areas caused by manufacturing tolerances are, however, in principle, harmless, since, on the one hand, the gas/gas mixer 12 is intended anyway for introducing the gas G into the exhaust gas A, and since, on the other hand, a substantial gas leak in these areas will not occur. A connection in substance of the two mixer body parts 22, 24 in the area of the downstream end areas 54 of the flow-through bulges 50 to the flow-through hole edge areas 46 of the second mixer body part 24 can, in principle, be provided, but is not necessary.

In the second mixer body part 24, the gas release openings 56, which have a hole-like configuration here as well, are provided in areas between the flow-through holes 48. These gas release openings 56 may, just as the flow-through holes 48, be provided in a regular pattern to achieve an approximately uniform introduction of the gas G into the exhaust gas A over the entire cross section. Considering the fact that the flow velocity and thus the throughput close to the wall 16 will be smaller than in the central area of the exhaust gas flow duct 18, provisions may be made in all embodiments according to the present invention that the density of the exhaust gas flow openings 44 or the total passage cross-sectional area provided by the exhaust gas flow openings 44 in the central area of the exhaust gas flow duct 18 is greater than in an area close to the wall 16 or increases from the wall 16 to the central area. This may also be provided in the gas release openings 56 so that where an especially greater portion of the exhaust gas A flows, a greater portion of the gas G is also introduced into the exhaust gas A.

It should be pointed out that, what a comparison of FIGS. 1 and 2 clearly shows, the dimensions of the mixer body 20 may also be influenced substantially by the configuration of the two mixer body parts 22, 24. Thus, the size of the gas feed volume 38 can be influenced, for example, by the length of the flow-through bulges 50 or of the fastening edge 34 of the first mixer body part 22. While the gas feed volume 38 has a greater extension in the exhaust gas main flow direction H in the exemplary embodiment shown in FIG. 1, the mixer body 20 in the embodiment according to FIG. 2 has a flatter configuration due to a corresponding configuration of the first mixer body part 22.

Further, it should be pointed out that the embodiments shown in FIGS. 1 and 2 may obviously be combined with each other. Thus, both gas release openings 56 with the ring-like structure shown in FIG. 1 can be provided in the area of the exhaust gas flow openings 44 and gas release openings 56 with the hole-like structure shown in FIG. 2 may be provided in the area between the exhaust gas flow openings 44. In this embodiment, for example, some of the exhaust gas flow openings 44 may have such a configuration, as shown in FIG. 1, i.e., with gas release opening 56 provided in association with it, while other exhaust gas flow openings 44 may have such a configuration, as shown in FIG. 2, i.e., without associated gas release opening.

Figure 3:
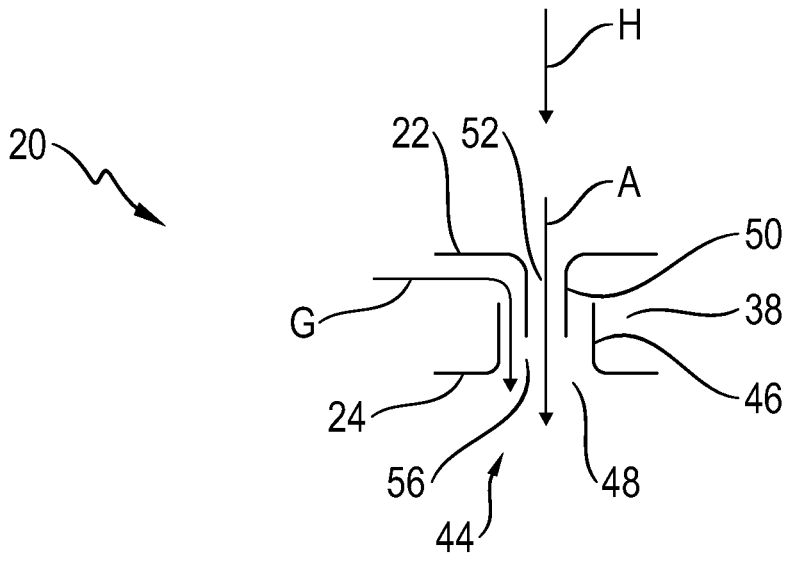
FIG. 3 is a view of an alternative type of configuration of a gas/gas mixer in the area of an exhaust gas flow opening.

A variant of the gas/gas mixer especially in regard to the configuration in the area of the exhaust gas flow openings 44 is shown in FIG. 3. In the area of the exhaust gas flow opening 44 which can be seen in FIG. 3, the second mixer body part 24 is shaped such that the flow-through hole edge area 46 enclosing the flow-through hole 48 is deflected against the exhaust gas main flow direction H, for example, is provided as a flanged hole. The flow-through hole edge area 46 is shaped or dimensioned such that it provides a larger opening cross section than the flow-through bulge 50 at the first mixer body part 22. In particular, the dimensioning is such that the flow-through bulge 50 extends in the area of the flow-through hole 48 into the volume enclosed by the flow-through hole edge area 46 and overlaps with the flow-through hole edge area 46 in the exhaust gas main flow direction H.

The ring-like intermediate space formed between the flow-through hole edge area 46 deflected against the exhaust gas main flow direction H and the flow-through bulge 50 provides a gas release opening 56, which, as in the exemplary embodiment of FIG. 1, has, in principle, a ring-like configuration and via which the gas G fed via the gas feed volume 38 is introduced into the exhaust gas A flowing through the exhaust gas flow duct 52 in the first mixer body part 22. Also, in this embodiment, because of the fact that the flow-through bulge 50 extending in the exhaust gas main flow direction H meshes with the flow-through hole edge area 46 extending opposite the exhaust gas main flow direction H or the volume enclosed by this flow-through hole edge area 46, an entry of exhaust gas A into the gas feed volume 38 is ruled out.

It should be noted that the gas/gas mixer 12 shown in the figures can be varied in many different aspects, without deviating from the principles of the present invention. Thus, for example, in the embodiment shown in FIG. 1, the flow-through bulges 50 may also be dimensioned such that they extend into the flow-through holes 48 or they extend through them. In all embodiments, as an alternative or in addition, one or more gas release openings 56 may also each be provided in the area of the flow-through bulges 50, as this is suggested in FIG. 2.

The exhaust gas flow openings 44 may have, for example, a circular opening cross section, but may also be provided with an elliptical, oval or other cross-sectional geometry. The same also applies to the gas release openings 56. Further, the two mixer body parts 22, 24 may be provided as integral components of a component provided by shaping a sheet metal blank, which can be folded over and then fixed to one another, e.g., by welding in some areas.

With the mixer according to the present invention, it is possible to introduce gas G into the exhaust gas stream over the entire cross section of the exhaust gas flow duct 18 and to mix same efficiently together with the exhaust gas flowing in the exhaust gas flow duct 18. In this case, the gas G to be mixed with the exhaust gas A may be, for example, the exhaust gas provided by a burner, which in a start phase of the combustion operation of an internal combustion engine can ensure a more rapid heating in case of a still cold catalytic converter device positioned downstream of the gas/gas mixer. In principle, any other type of gas, for example, air, could be mixed with the exhaust gas stream in order to obtain an improved operating characteristic in system areas following downstream of the gas/gas mixer 12.

While specific embodiments of the invention have been shown and described in detail to illustrate the application of the principles of the invention, it will be understood that the invention may be embodied otherwise without departing from such principles.

What is claimed is:

1. A gas/gas mixer for introducing gas into an exhaust gas stream of an internal combustion engine, the gas/gas mixer comprising:

an exhaust gas flow duct in an exhaust gas carrying element, through which exhaust gas can flow; and a mixer body arranged in the exhaust gas carrying element, the mixer body having a plurality of exhaust gas flow openings, through which exhaust gas, flowing in the exhaust gas flow duct, can flow through, wherein:

a gas feed volume, through which gas to be introduced into the exhaust gas stream can flow, is formed in the mixer body;

the gas feed volume is open towards the exhaust gas flow duct via a plurality of gas release openings;

the mixer body comprises a first mixer body part that is arranged in the exhaust gas carrying element oriented in an upstream direction;

the mixer body comprises a second mixer body part that is arranged in the exhaust gas carrying element oriented in a downstream direction;

the gas feed volume is at least partially formed between the first mixer body part and the second mixer body part;

the second mixer body part has a plurality of flow-through holes providing the exhaust gas flow openings; and the first mixer body part comprises flow-through bulges, each of which extends to the second mixer body part and carries exhaust gas in a direction of the associated flow-through hole and provides a flow duct of the first mixer body part, in association with each flow-through hole of the second mixer body part.

2. The gas/gas mixer in accordance with claim 1, wherein the mixer body has a plate-shaped configuration and is arranged in the exhaust gas carrying element obliquely to an exhaust gas main flow direction of the exhaust gas flowing through the exhaust gas flow duct.

3. The gas/gas mixer in accordance with claim 1, wherein:

the mixer body has a plate-shaped configuration and is arranged in the exhaust gas carrying element obliquely to an exhaust gas main flow direction of the exhaust gas flowing through the exhaust gas flow duct; and the first mixer body part has an essentially plate-shaped configuration, and the second mixer body part has an essentially plate-shaped configuration.

4. The gas/gas mixer in accordance with claim 1, wherein:

a first fastening area, fixed to the exhaust gas carrying element, is provided at one of the mixer body parts; and a second fastening area, fixed to said one mixer body part, is provided at another mixer body part.

5. The gas/gas mixer in accordance with claim 4, wherein:

the first fastening area comprises a fastening edge fixed to an inner surface of the exhaust gas carrying element in an outer circumferential area of the one mixer body part; or the second fastening area comprises a fastening edge fixed to the one mixer body part in an outer circumferential area of the other mixer body part; or the first fastening area comprises a fastening edge fixed to an inner surface of the exhaust gas carrying element in an outer circumferential area of the one mixer body part and the second fastening area comprises a fastening edge fixed to the one mixer body part in an outer circumferential area of the other mixer body part.

6. The gas/gas mixer in accordance with claim 1, wherein at least one of the gas release openings is formed between a flow-through hole edge area, of at least one of the exhaust gas flow openings, of the second mixer body part, which flow-through hole edge area encloses a corresponding one of the flow-through holes and a corresponding one of the flow-through bulges of the first mixer body part.

7. The gas/gas mixer in accordance with claim 1, wherein:

the gas release openings are provided in the second mixer body part with at least some of the gas release openings disposed between flow-through holes provided in the second mixer body part; or at least one of the gas release openings is provided in the first mixer body part; or the gas release openings are provided in the second mixer body part with at least some of the gas release openings disposed between flow-through holes provided in the second mixer body part and at least one of the gas release openings provided in the first mixer body part.

8. The gas/gas mixer in accordance with claim 7, wherein the flow-through bulge is in contact with a flow-through hole edge area of the second mixer body part, which flow-through hole edge area encloses the flow-through hole in the second mixer body part such that the gas feed volume is essentially closed against the discharge of gas in an area of the at least one exhaust gas flow opening.

9. The gas/gas mixer in accordance with claim 1, wherein:

the first mixer body part is a shaped sheet metal part; or the second mixer body part is a shaped sheet metal part; or the first mixer body part is a shaped sheet metal part and the second mixer body part is a shaped sheet metal part.

10. The gas/gas mixer in accordance with claim 1, further comprising a gas feed duct at an outer circumferential area of the mixer body, the gas feed duct passing through a wall of the exhaust gas carrying element and the gas feed duct being open towards the gas feed volume.

11. The gas/gas mixer in accordance with claim 1, wherein the mixer body is arranged in the exhaust gas carrying element such that exhaust gas essentially only flows through the exhaust gas flow openings in the exhaust gas flow duct in an area of the mixer body.

12. An exhaust system for an internal combustion engine of a vehicle, the exhaust system comprising a gas/gas mixer, the gas/gas mixer comprising:

an exhaust gas flow duct in an exhaust gas carrying element, through which exhaust gas can flow; and a mixer body arranged in the exhaust gas carrying element, the mixer body having a plurality of exhaust gas flow openings, through which exhaust gas, flowing in the exhaust gas flow duct can flow through, wherein:

a gas feed volume, through which gas to be introduced into the exhaust gas stream can flow, is formed in the mixer body;

the gas feed volume is open towards the exhaust gas flow duct via a plurality of gas release openings;

the mixer body comprises a first mixer body part that is arranged in the exhaust gas carrying element oriented in an upstream direction;

the mixer body comprises a second mixer body part that is arranged in the exhaust gas carrying element oriented in a downstream direction;

the gas feed volume is at least partially formed between the first mixer body part and the second mixer body part;

the second mixer body part has a plurality of flow-through holes providing the exhaust gas flow openings;

the first mixer body part comprises flow-through bulges, each of which extends to the second mixer body part and carries exhaust gas in a direction of the associated flow-through hole and provides a flow duct of the first mixer body part, in association with each flow-through hole of the second mixer body part.

13. The exhaust system in accordance with claim 12, wherein the mixer body has a plate-shaped configuration and is arranged in the exhaust gas carrying element obliquely to an exhaust gas main flow direction of the exhaust gas flowing through the exhaust gas flow duct.

14. The exhaust system in accordance with claim 12, wherein:

the mixer body has a plate-shaped configuration and is arranged in the exhaust gas carrying element obliquely to an exhaust gas main flow direction of the exhaust gas flowing through the exhaust gas flow duct; and the first mixer body part has an essentially plate-shaped configuration, and the second mixer body part has an essentially plate-shaped configuration.

15. The exhaust system in accordance with claim 12, wherein:

a first fastening area, fixed to the exhaust gas carrying element, is provided at one of the mixer body parts; and a second fastening area, fixed to said one mixer body part, is provided at another mixer body part.

16. The exhaust system in accordance with claim 12, wherein the gas/gas exhaust mixer further comprises a gas feed duct at an outer circumferential area of the mixer body, the gas feed duct passing through a wall of the exhaust gas carrying element and the gas feed duct being open towards the gas feed volume.

* * * * *